United States Patent [19]

Balma

[11] Patent Number: 4,984,729

[45] Date of Patent: Jan. 15, 1991

[54] EASY ACCESS METAL STAPLE STAPLER

[76] Inventor: Giorgio Balma, Viale della Repubblica, 13, 27058 Voghera (Pavia), Italy

[21] Appl. No.: 332,622

[22] Filed: Apr. 3, 1989

[30] Foreign Application Priority Data

Apr. 22, 1988 [IT] Italy ..... 20317 A/88

[51] Int. Cl.[5] ..... B25C 5/02; B25C 5/11

[52] U.S. Cl. ..... 227/128; 227/120; 227/123; 227/144

[58] Field of Search ..... 227/120, 123, 128, 144, 227/153

[56] References Cited

U.S. PATENT DOCUMENTS

| | | | |
|---|---|---|---|
| 2,682,053 | 6/1954 | Ruskin et al. | 227/144 X |
| 2,795,787 | 6/1957 | Spencer | 227/144 X |
| 2,920,324 | 1/1960 | Kufel, Jr. et al. | 227/128 |
| 3,656,678 | 4/1972 | Ruskin | 227/128 |
| 4,243,168 | 1/1981 | Balma | 227/123 X |
| 4,288,019 | 9/1981 | Dahle | 227/144 |

*Primary Examiner*—Paul A. Bell

*Attorney, Agent, or Firm*—Bucknam and Archer

[57] ABSTRACT

A metal staple stapler comprises a loading body which is provided, at the rear thereof, with a pair of ears supporting a pivot pin thereon there is pivoted an outer casing including a pressing member, and a metal staple driver member for driving the metal staples contained in the loading body, while under the loading body there is arranged a staple clamp for closing the metal staples, an actuating lever being moreover provided, pivoted, at an intermediate position thereof, about a pivot pin associated with the clamp, the actuating lever including, at its top end, a hook portion removably coupled to a pressing roller adapted to rotate the outer casing and eject and close the metal staple.

3 Claims, 3 Drawing Sheets

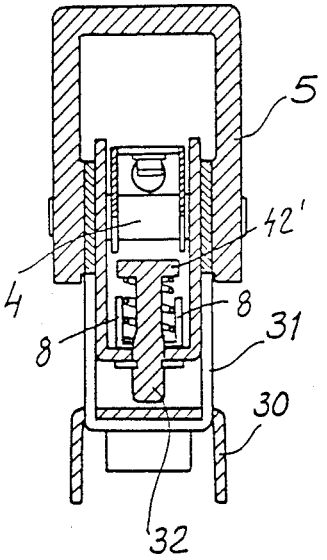
Fig. 3
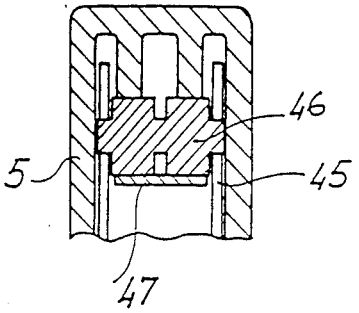
Fig. 4
Fig. 6
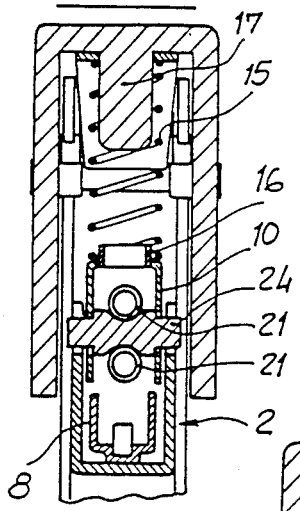
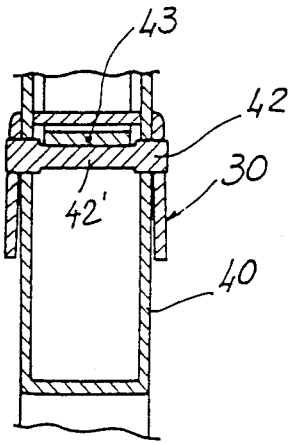
Fig. 5
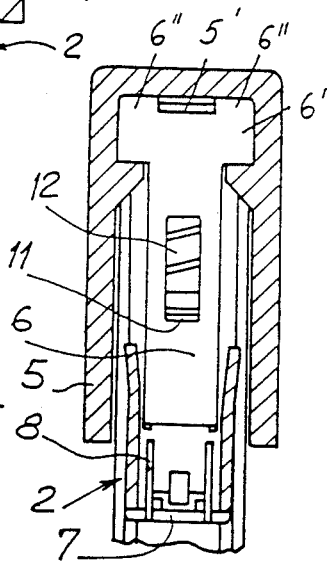
Fig. 7

EASY ACCESS METAL STAPLE STAPLER

BACKGROUND OF THE INVENTION

The present invention relates to an easy access and maintenance metal staple stapler apparatus.

As is known, metal staple staplers of the so-called pliers type are usually provided with a staple loading device for housing and guiding the metal staples, which are resiliently driven by a driver toward the front portion of the stapler, where a pressing member ejects and closes the metal staples.

More specifically the loading of the metal staples is generally carried out by introducing, at the stapler rear end, and upon withdrawing the driver, the metal staplers; in other staples, on the other hand, the metal staples are introduced at the front end of the stapler, upon removing from the front the loader.

In both types of staplers, if a metal staple is locked inside the apparatus, it is very difficult to access the inside of the stapler in order to remove the jammed staple.

Another drawback of known staplers is that they have a comparatively low metal staple holding capability.

Moreover these known staplers are very complex construction-wise and comprise a lot of component parts of difficult and time consuming assembling.

SUMMARY OF THE INVENTION

Accordingly, the aim of the present invention is to overcome the above mentioned drawbacks of known metal staple staplers by providing a new and novel type of stapler which can be easily and quickly accessed and subjected to maintenance, in particular which can be easily and quickly opened with a full removal of the metal staple loader from the stapler casing.

Within the scope of the above aim, a main object of the present invention is to provide such a metal staple stapler which has a very high staple holding capability, while preserving the overall size of a conventional stapler.

Another object of the present invention is to provide such a metal staple stapler which can be assembled in a very quick way at a comparatively low cost.

According to one aspect of the present invention, the above mentioned task and objects, as well as yet other objects, which will become more apparent hereinafter, are achieved by a metal staple stapler according to the claims.

BRIEF DESCRIPTION OF THE DRAWINGS

Further characteristics and advantages of the present invention will become more apparent hereinafter, from the following detailed description of a preferred, though not exclusive embodiment, of a metal staple stapler according to the invention, which is illustrated, by way of an indicative but not limitative example in the accompanying schematic drawings, in which:

FIG. 3 is a cross-sectional view taken along the line III—III of FIG. 1;

FIG. 4 is another cross-sectional view of the subject stapler, taken along the line IV—IV of FIG. 1;

FIG. 5 is another cross-sectional view of the subject stapler, taken along the line V—V of FIG. 1;

FIG. 6 is yet another cross-sectional view of the subject stapler, taken along the line VI—VI of FIG. 1;

FIG. 7 is yet another cross-sectional view of the subject stapler, taken along the line VII—VII of FIG. 1.

DESCRIPTION OF THE PREFERRED EMBODIMENT

Figure 1:
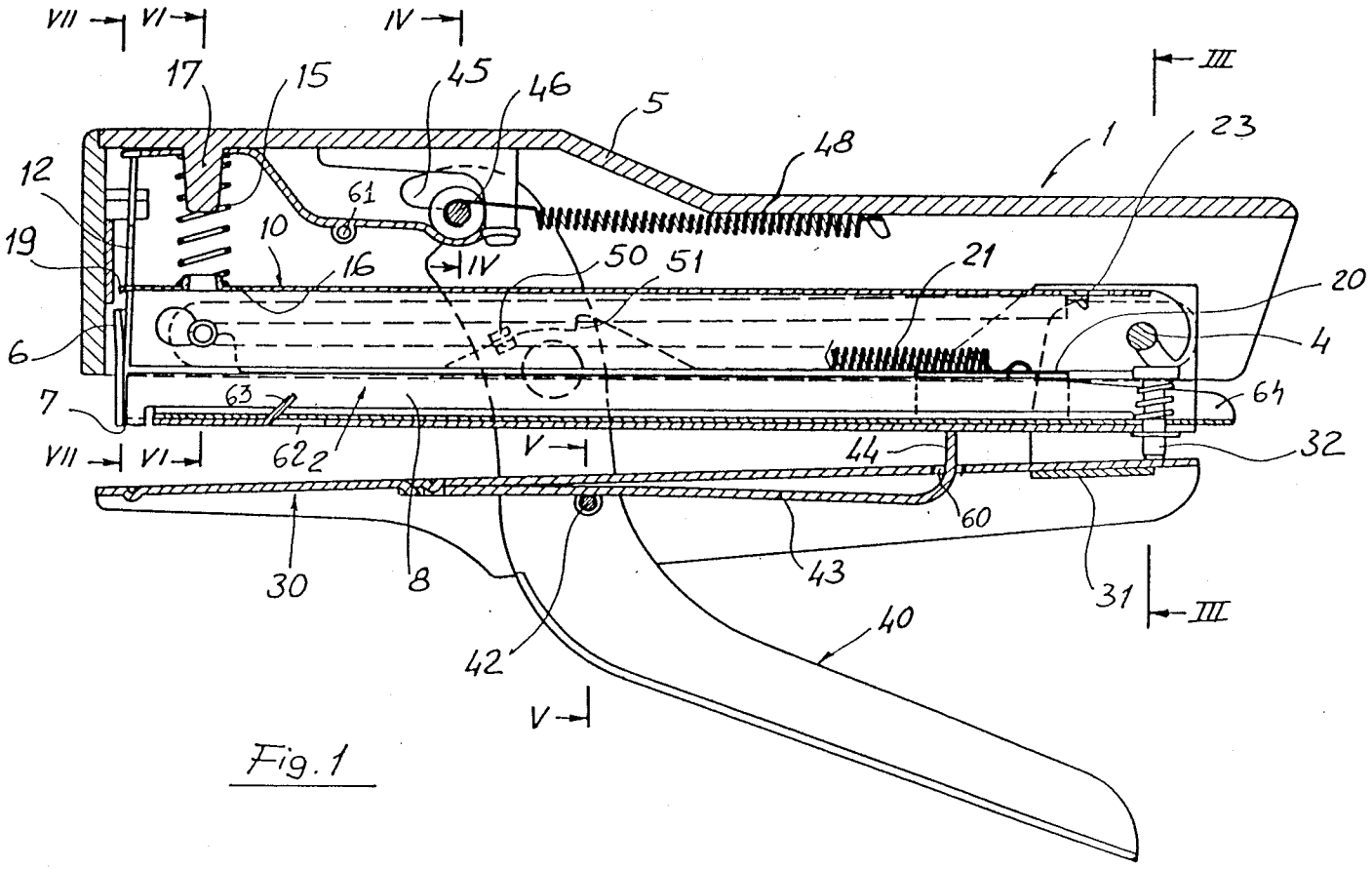
FIG. 1 is a schematic longitudinal cross-sectional view of the stapler according to the present invention.

With reference to the figures of the accompanying drawings, the metal staple stapler according to the present invention, which is indicated overally at the reference number 1, comprises a metal staple loading body 2, of elongated shape, which, at the rear portion thereof, supports a pivot pin 4 thereon there is pivoted an outer casing 5 which has a substantially U-shaped cross-section.

Inside the mentioned outer casing 5, at its front end portion, there is provided a pressing member 6, of blade or sheet like shape, which can be introduced into a front slot or opening 7 formed through the loading body at the end of a guide rail member 8 thereon the metal staples can be applied, as it will be disclosed in a more detailed way hereinafter.

The mentioned pressing member 6, as is clearly shown in FIG. 7, consists substantially of a blade member having an enlarged top end portion 6' which, by means of two legs 6'', is held in its proper position by bracket members 5' formed on the outer casing 5.

Inside said outer casing 5, in particular, there is arranged a closure element 10 which is located above the metal staple loading body, said closure element 10 being also pivoted on the pin 4 and being provided with a front lug 11 which projects and passes through a slot 12 formed through the pressing element 6 rigid with the outer casing 5.

By the disclosed coupling, the closure member 10 can swing with respect to the outer casing and is resiliently biassed by a return spring 15 operating between a boss 16, formed on the top portion of the closure element 10 and a centering pin 17 which, preferably, is formed as a single piece on the mentioned outer casing 5.

Inside the closure element 10 there are provided resilient means pushing or biassing a staple driver 20 which is slidably guided on the metal staple guide rail member 8, said resilient means consisting preferably of a coil spring 21 which, at one end thereof, has a point fixed on a tab 23, formed on the element or body 10 and extending on a small pulley 24 arranged near the front end portion of the body 10 and connected with the staple driver 20.

With such an arrangement, the coil spring will subject the driver 20 to a pulling force so as to drive the metal staples, held in the loading body, toward the front end portion where there is arranged the slot 7.

Moreover, as the stapler is opened, as it will be disclosed in a more detailed way hereinafter, and as is clearly shown in FIG. 2, the driver 20 will be automatically caused to return to the rear end portion of the guide rail member 8, thereby allowing the metal staples to be easily introduced into the stapler.

Under the staple loading body 2 there is provided a staple clamp, indicated overally at the reference number 30, which, at its rear portion, is associated with a bracket 31 also pivoted on the mentioned pin 4.

As shown, the stapler comprises furthermore an actuating lever, indicated overally at the reference number 40 which, at an intermediate position thereof, is pivoted on the pin 42 which is in turn applied to the clamp 30.

Through the latter there is provided a slot 60 there through there is caused to pass the curved end of a leaf spring which is held in its operating position by the mentioned pin 42 which thus operates also as an affixing member for said spring 43.

In this connection it should be pointed out that the pin 42 if provided, at its center portion 42', with a smaller diameter in order to allow said leaf spring to be perfectly located and prevent said pin 42 from disengaging (see FIG. 5).

At its top end portion, the actuating lever 40 is provided with a hook portion, indicated at the reference number 45, which is opened at the front so as to removably engage with a pressing roller 46 sliding on a track 47 which is associated, through the pin 61, with the inner surface of the outer casing 5.

A further return spring 48 is moreover provided which affects the roller 468 in order to hold it at a withdrawn position, at rest.

As is shown, on the actuating lever 40 there are provided abutment legs or tabs which engage with an end of stroke limit member 51, formed on the staple loading body, and adapted to restrain the rotation of the actuating lever in the opposite direction to the staple applying direction.

With the disclosed arrangement, as the actuating lever 40 is pressed, the clamp 30 will e displaced nearer the staple loading body 2, so as to clamp the sheet material to be joined by the metal staples.

Then, the roller 46, by sliding on the track 47, causes a lowering displacement with a consequent rotation about the pin 4.

Contemporaneously, by pressing the pressing member 6 through the track 47, said pressing member is caused to enter the front end portion of the staple loading body 2, thereby a metal staple will be ejected and closed.

Figure 2:
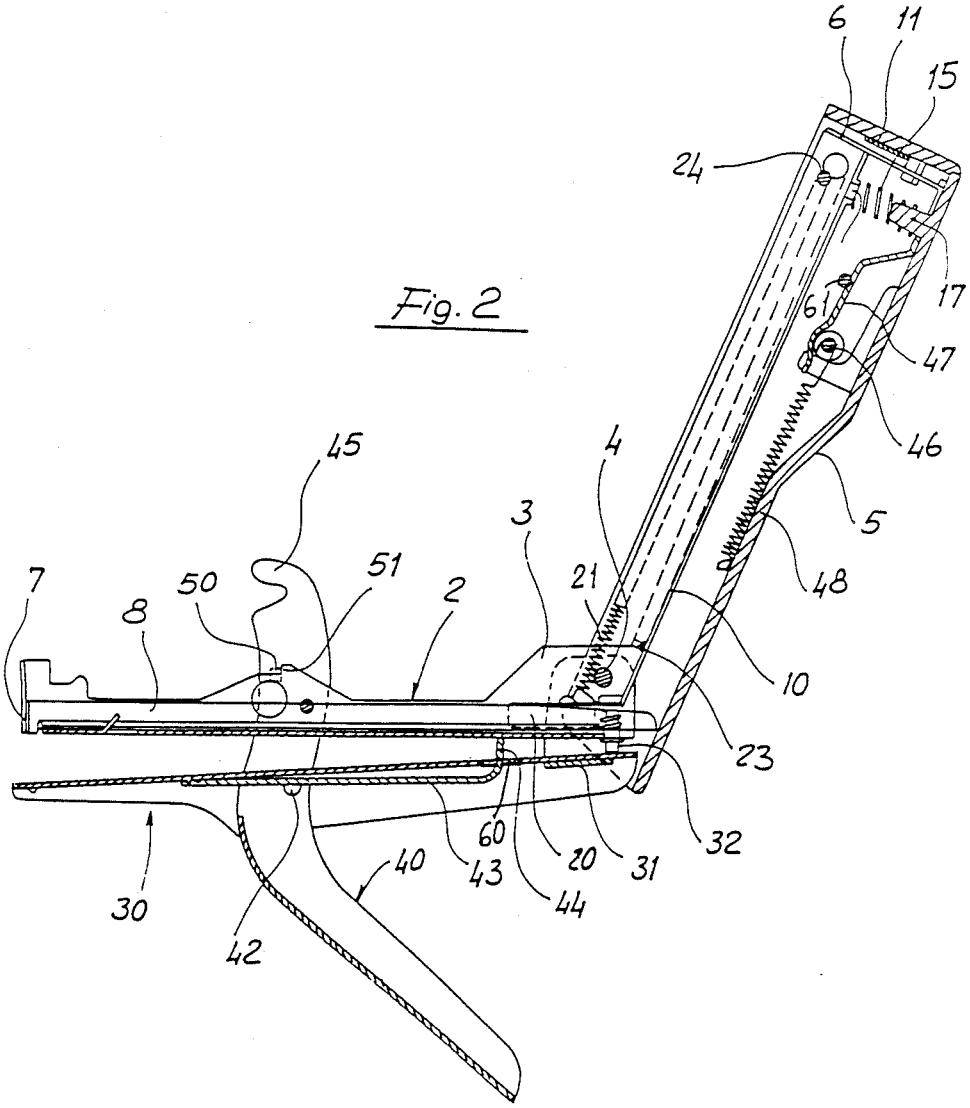
FIG. 2 is a further longitudinal cross-sectional view illustrating the subject stapler in its open condition.

As new metal staples are to be loaded into the stapler, the actuating lever 40 wil be turned in an opposite direction to the operating direction, so as to disengage the hook member 45 from the roller 46, thereby fully opening the stapler since the outer casing of the stapler, with the closure element associated therewith, will be spaced away by the greatest distance from the loading body, as is clearly shown in FIG. 2.

Under this condition, a great amount of metal staples can be easily loaded into the stapler and moreover, if required, the stapler can be easily accessed for removing therefrom possible not properly arranged staples.

As stated, the stapler according to the present invention is provided with a guide rail member 8 which is coupled to the loading body 2 by means of a pin 32 which includes a spring 32'.

This pin has a head portion 42' and an intermediate body 42'', having two diameters, respectively smaller at the top portion thereof and greater at the bottom portion thereof, which are coupled by a conical or tapering portion.

The greater diameter portion is housed, with a precise tolerance, in a hole formed on the loading body 2 and in a corresponding hole formed in the guide rail 8.

At its front portion, the guide rail 8 is provided with an elongated slot 62 therein engages a leg or tab 63 formed by punching and bending a portion of the loading body 2.

If a metal staple jammed the stapler, it can be quickly and easily removed by a slight upward pressure on the rear portion 64 of the mentioned guide rail 8.

Thus the guide rail will be caused to withdraw so as to spread apart the slot 7 in order to eject the locked in staple.

From the above disclosure, it should be apparent that the invention fully achieves the intended task and objects.

While the invention has been disclosed and illustrated with reference to a preferred embodiment thereof, it should be apparent that the disclosed embodiment would be susceptible to several modifications and variations, all of which will come within the scope and spirit of the invention as defined in the appended claims.

I claim:

1. A metal staple stapler comprising a metal staple loading body provided with a pair of ears supporting a pivot pin, an outer casing pivoted on said pivot pin, said outer casing including a pressing member, a closure member housing resilient pushing means actuating a staple driver, under said loading body there being provided a clamp for closing said metal staples, actuating lever being furthermore provided articulated at an intermediate position thereof on said clamp, said actuating lever including a top hook portion removably engageable with a pressing roller sliding on a track of said outer casing, through said clamp being formed a slot therein there is engaged a curved end of a leaf spring held in an operating position by a restraining pin.

2. A stapler according to claim 1, wherein said restraining pin has a central reduced diameter portion adapted to allow said leaf spring to be precisely arranged and prevent said restraining pin from disengaging.

3. A stapler according to claim 1, wherein said pressing member comprises a blade member including an enlarged top end which, by means of two legs, is held in place by brackets formed on said outer casing.

* * * * *